US007597604B2

(12) United States Patent
Kao et al.

(10) Patent No.: US 7,597,604 B2
(45) Date of Patent: Oct. 6, 2009

(54) METHOD OF MANUFACTURING BARRIER RIBS FOR A PLASMA DISPLAY PANEL

(75) Inventors: Hsu-Pin Kao, Ping Chen (TW); Chung-Wang Chou, Taoyuan Hsien (TW); Ching-Hui Lin, Taoyuan (TW); Sheng-Wen Hsu, Taipei (TW)

(73) Assignee: Chunghwa Picture Tubes, Ltd., Taipei (TW)

( * ) Notice: Subject to any disclaimer, the term of this patent is extended or adjusted under 35 U.S.C. 154(b) by 229 days.

(21) Appl. No.: 11/783,139

(22) Filed: Apr. 6, 2007

(65) Prior Publication Data

US 2007/0184746 A1 Aug. 9, 2007

Related U.S. Application Data

(62) Division of application No. 10/753,345, filed on Jan. 9, 2004, now Pat. No. 7,215,076.

(30) Foreign Application Priority Data

Jun. 27, 2003 (TW) ..... 92117706 A

(51) Int. Cl.
*H01J 9/00* (2006.01)

(52) U.S. Cl. ..... 445/24; 445/25

(58) Field of Classification Search ..... 445/24, 445/25

See application file for complete search history.

(56) References Cited

U.S. PATENT DOCUMENTS

| | | | | |
|---|---|---|---|---|
| 6,747,409 | B1 | 6/2004 | Han et al. | |
| 6,864,632 | B2 | 3/2005 | Kao et al. | |
| 2004/0007975 | A1 * | 1/2004 | Kao et al. | 313/582 |

FOREIGN PATENT DOCUMENTS

| | | | |
|---|---|---|---|
| CN | 1538486 | | 10/2004 |
| JP | 04248585 | A | 9/1992 |
| JP | 2001035391 | A | 2/2001 |
| TW | 588397 | A | 5/2004 |

* cited by examiner

*Primary Examiner*—Mariceli Santiago
(74) *Attorney, Agent, or Firm*—Hoffman, Wasson & Gitler, P.C.

(57) ABSTRACT

The present invention provides a PDP structure including a first substrate, a second substrate and a Waffle barrier rib structure located between the first and second substrate. The Waffle barrier rib structure includes three first barrier ribs having different width and a plurality of second barrier ribs perpendicular to the first barrier ribs. The second barrier ribs are located between the two first barrier ribs, and connect the wider structure of the two first barrier ribs. Therefore, discharge spaces are formed. Because of different width, the height difference of the barrier rib structure is formed after thermal process. Hence, gas can pass through the barrier ribs structure between the front and the back substrate sealed together.

6 Claims, 10 Drawing Sheets

METHOD OF MANUFACTURING BARRIER RIBS FOR A PLASMA DISPLAY PANEL

CROSS-REFERENCE TO RELATED APPLICATIONS

This application is a divisional of U.S. patent application Ser. No. 10/753,345; filed on Jan. 9, 2004 now U.S. Pat. No. 7,215,076, issued on May 8, 2007.

FIELD OF THE INVENTION

The present invention relates to a plasma display panel (PDP), and more particularly to a barrier rib structure for a plasma display panel.

BACKGROUND OF THE INVENTION

Plasma display panels (PDP) can be divided into two types, the direct current (DC) type and the alternating current (AC) type, according to their electrical driving mode. In a conventional AC-type PDP, glass plates undergo several manufacturing steps in which many functional layers the layers are formed thereon and are then combined together by sealing the periphery of the glass plates. A mixed gas with a predetermined ratio is then introduced into the discharge units between the glass plates.

In FIG. 1, a plurality of parallel electrodes 12 and 14 are alternatively arranged on the front plate 10. The two electrodes are respectively used as the scan electrode and the common electrode. The electrode 12 is composed of a bus electrode 12*a* and a transparent electrode 12*b*. The electrode 14 is composed of a bus electrode 14*a* and a transparent electrode 14*b*. A dielectric layer 16 and a protective layer 18 are sequentially formed on the electrodes 12 and 14. Similarly, a plurality of parallel address electrodes 20 is formed on the back plate 12. A dielectric layer 22 is formed on the address electrode 20. A plurality of parallel barrier ribs 24 are formed on the dielectric layer 22. Each barrier rib 24 is located between adjacent address electrode 20. A fluorescencer 64 is coated on the barrier ribs 24. Electrodes 12 and 14 on the front plate 10 and address electrode 10 on the back plate 12 are perpendicularly crossed. The barrier ribs 24, electrode 12 and electrode 14 comprise a discharge unit 28 as illustrated in the FIG. 2.

FIG. 2 is a schematic, cross-sectional view of a discharge unit, in a conventional AC-type PDP 10, referring to FIG. 1 and 2 simultaneously, a plurality of parallel-arranged transparent electrodes 12*b* are formed on the front plate 10. When a voltage is applied to a specific discharge unit 28 to induce discharge, the mixed gas in the discharge unit 28 emits ultraviolet (UV) rays to light the fluorescencer 26 inside the discharge unit 28. The fluorescencer 26 then emits a visible light, such as a red (R), green (G) or blue (B) light. According to this structure, the fluorescencer 26 can only be coated on the sidewalls of the barrier ribs and the top surface of the dielectric layer 22, so that only three planes are utilized.

Since an erroneous discharge may occur in a non-discharge region B, illustrated in FIG. 3, of the conventional AC-type PDP, the distance d between two discharge units 30 of two adjacent discharge regions A must be increased to prevent the same. Although a larger non-discharge region B prevents erroneous discharge, discharge regions A are then relatively contracted, i.e., have a reduced opening ratio, and luminescence efficiency is thus decreased. Conversely, a smaller non-discharge region B provides larger discharge regions A, but erroneous discharge then readily occurs, so that neighboring discharge regions A are affected during operation.

A conventional method for solving the erroneous discharge issue in non-discharge region B is to develop a different barrier rib structure as illustrated in FIG. 4. For example, a Waffle structure 24 having sealed latticed barrier ribs has been provided. This structure uses a barrier rib to isolate the discharge region A and the non-discharge region B. The discharge region A is a closed space according to this structure. Therefore, the problem of erroneous discharge occurring in the non-discharge region B is solved. On the other hand, the fluorescencer can be coated on the five planes of each discharge unit, i.e., front, back, left, right and bottom planes, thereby improving luminescence efficiency by increasing the fluorescencer coating area.

However, in the conventional method, the vacuuming and gas refilling steps are performed between the discharge region A and non-discharge region B after the front and back glass plates of the PDP are adhered to each other, so the closed discharge and non-discharge regions results in greater difficulties during performance of the two steps. To avoid the above problem, the front plate requires a new design to form a height difference in the surface of the front plate, so that some gas channels are formed after the front and back glass plates of the PDP are adhered to each other. The vacuuming and refilling gas steps is improved through these gas channels. However, the structure requires redesign of the front plate, which increases manufacturing difficulties. According to the above descriptions, the barrier rib structure of a conventional PDP has many drawbacks; for example, the structure is prone to erroneous discharge, the luminescence efficiency is low, or the structure is hard to vacuum.

SUMMARY OF THE INVENTION

The present invention provides a barrier rib structure for a plasma display panel (PDP) that can resolve the above problems as shown in the conventional method.

It is a main object of the present invention to provide a barrier rib structure. In accordance with the present invention, a Waffle barrier rib structure with different height is provided. The height difference in the Waffle barrier rib structure of the front plate may form some gas channels after the front and back plates of the PDP are adhered to each other, which cannot only avoid the erroneous discharge but also improve the vacuuming and refilling gas efficiency.

The other object of the present invention is to apply this Waffle barrier rib structure with different height to any PDP. Accordingly, this structure provides a larger fluorescencer coating area and an electrode structure with dual discharge units. Therefore, a better discharge efficiency can be reached.

Accordingly, the PDP structure comprises a first substrate, a second substrate and a Waffle barrier rib structure located between the first and second substrate. The Waffle barrier rib structure comprises a plurality of parallel barrier ribs arranged in a horizontal direction and a plurality of parallel barrier ribs arranged in a vertical direction. Each barrier rib arranged in a horizontal direction on the back plate is designed to form different widths. In other words, barrier ribs arranged in a horizontal direction are formed by a plurality of wide sections and narrow sections, and the wide sections and the narrow sections are alternatingly formed. The barrier ribs arranged in a vertical direction are respectively connected to the wide sections to form a plurality of discharge units. The barrier ribs arranged in a horizontal direction comprise a first, a second and a third barrier rib arranged in a horizontal direction.

The manufacturing method of the present invention comprises forming the Waffle barrier rib structures on the back plate and then performing a sintering process to form a height difference between the wide section and the narrow section of the barrier rib.

The PDP structure of the present invention comprises a first substrate, an electrode structure, a plurality of address electrodes, a plurality of barrier rib units and a second substrate. The electrode structure is composed of a plurality of scan electrodes and a plurality of common electrodes, wherein both of them are arranged in parallel. The scan electrodes and the common electrodes are arranged in perpendicular to the address electrodes. A plurality of discharge units are formed in each barrier rib unit. A horizontal channel is formed between two adjacent barrier rib units.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENT

A plurality of embodiments are described in the following to interpret the barrier rib structure of a plasma display panel according to the present invention. The aspects and many of the attendant advantages of this intention will become more readily appreciated as the same becomes better understood by reference to the following detailed description, when taken in conjunction with the accompanying drawings, FIG. 5 to FIG. 10. The present invention provides a Waffle-sharp barrier rib structure, wherein the structure of each barrier rib arranged in a horizontal direction on the back substrate is designed to form different widths. The different width structure may cause different contractibilities during the sintering process. The different contractibilities form height differences for each barrier rib.

Figure 1:
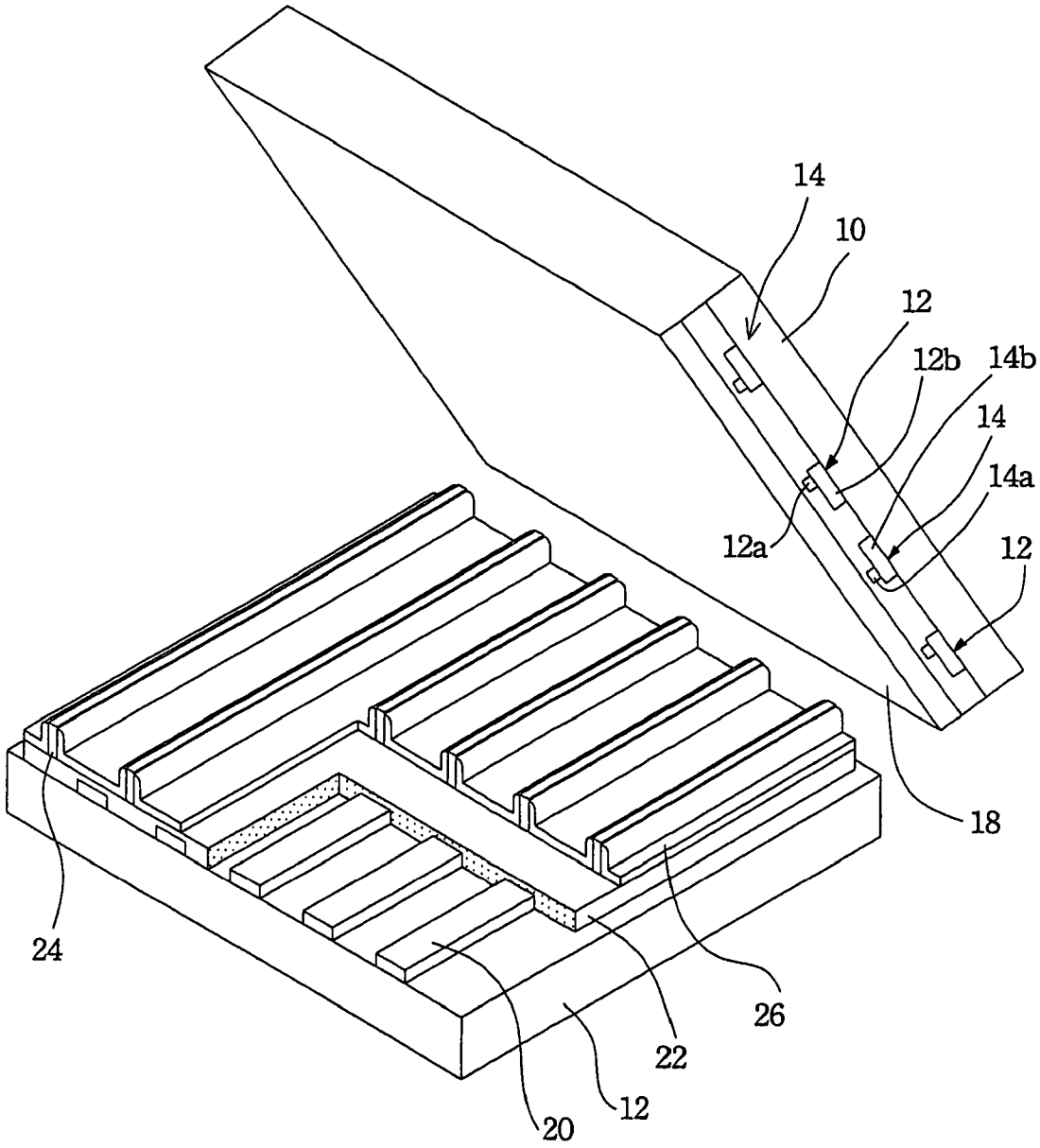
Fig. 1 (PRIOR ART)
FIG. 1 is a schematic assembly diagram of a front substrate and a back substrate of a conventional plasma display panel.
Figure 2:
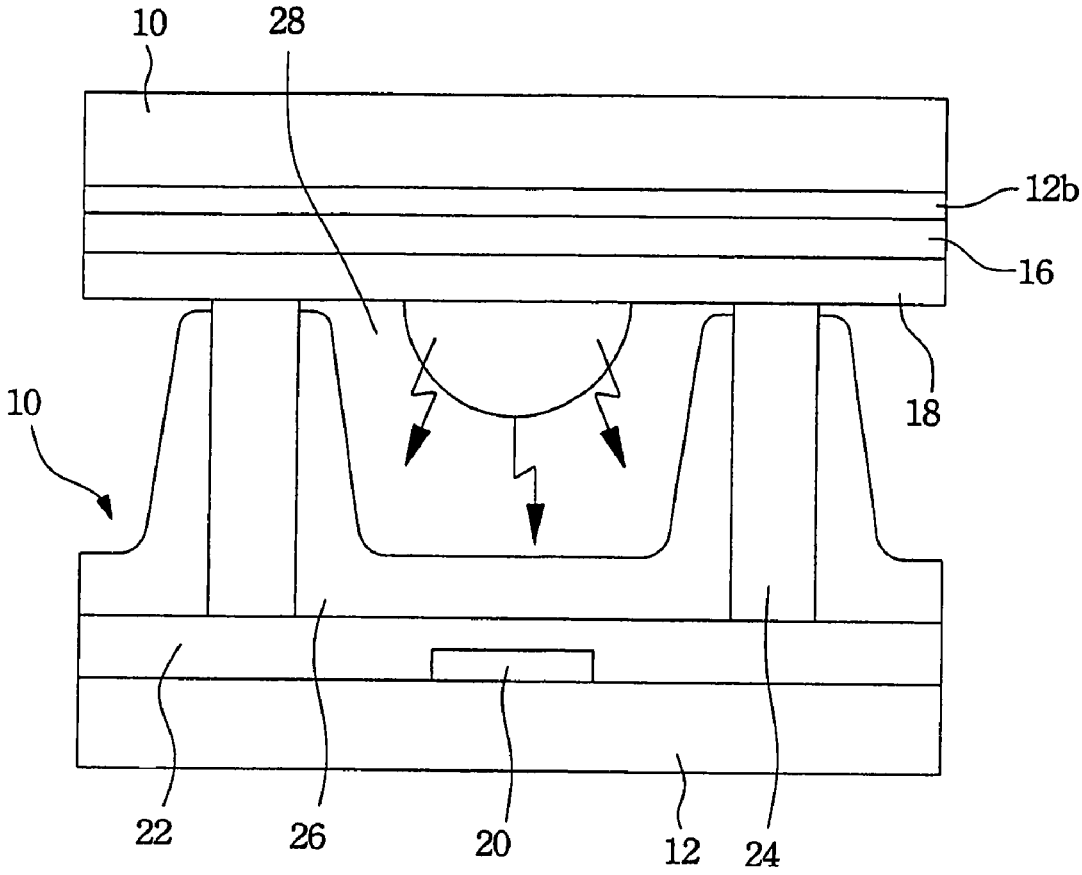
Fig. 2 (PRIOR ART)
FIG. 2 is a schematic, cross-sectional view of a conventional plasma display panel.
Figure 3:
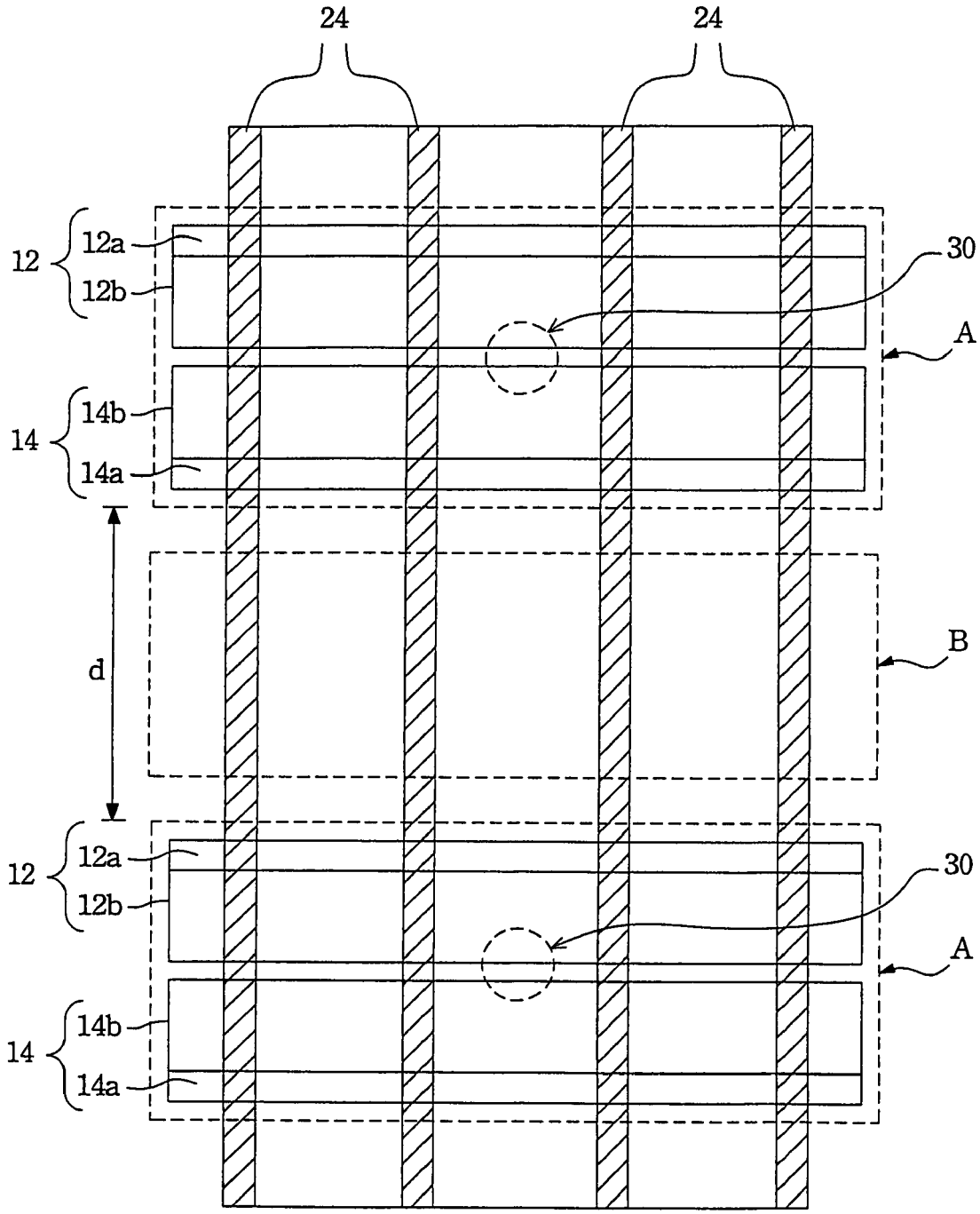
Fig. 3 (PRIOR ART)
FIG. 3 is a schematic top view of an electrode structure located over a barrier rib of a conventional plasma display panel.
Figure 4:
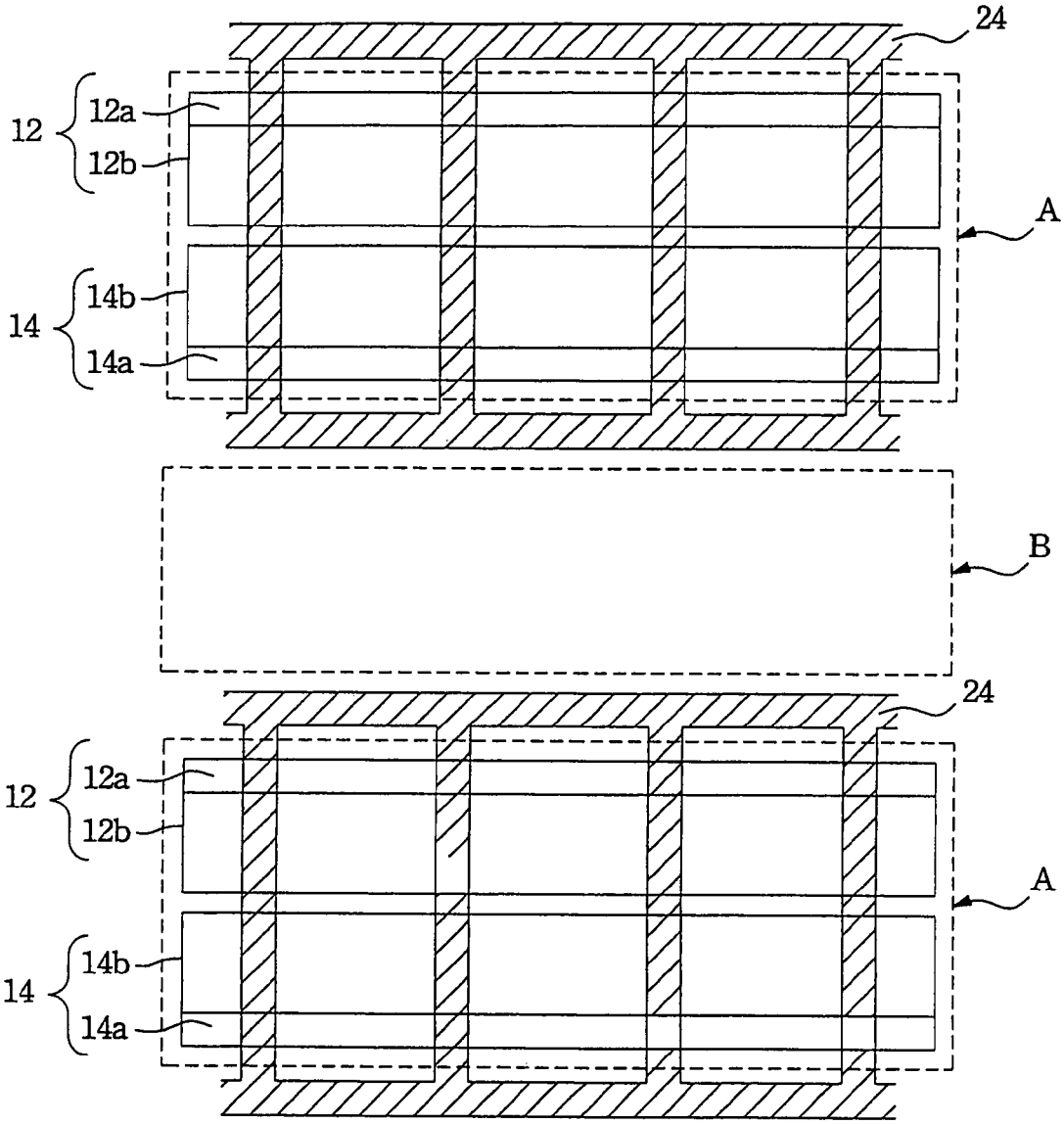
Fig. 4 (PRIOR ART)
FIG. 4 is a schematic top view of a conventional plasma display panel having a Waffle structure discharge space.
Figure 5:
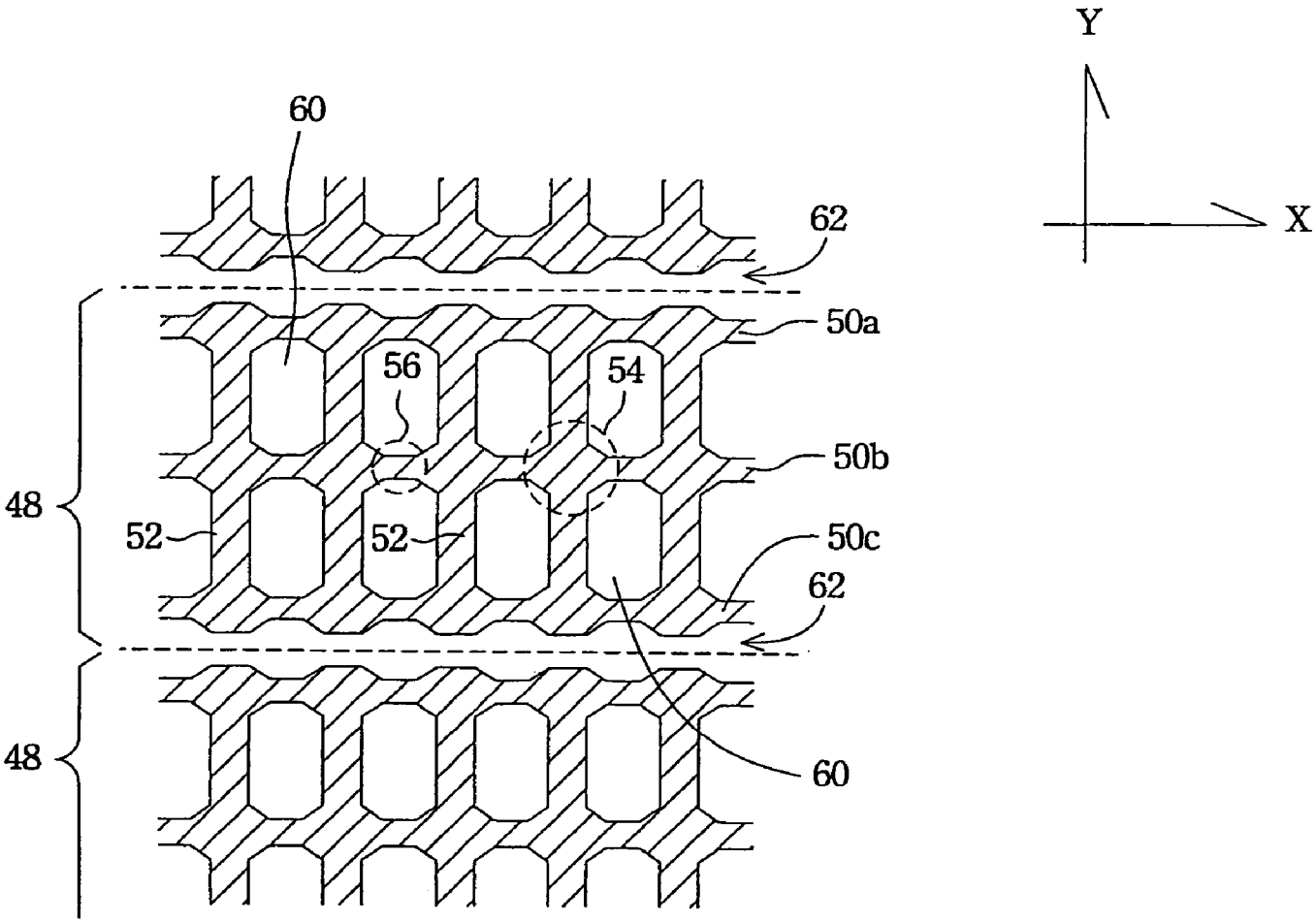
FIG. 5 is a schematic top view of a barrier rib structure on a back substrate of a plasma display panel according to one preferred embodiment of the present invention.

FIG. 5 is a schematic assembly diagram of a plasma display panel according to one preferred embodiment of the present invention. The plasma display panel (PDP) of the present invention at least comprises a front substrate and a back substrate. The barrier rib structure of the present invention is formed between the front substrate and the back substrate. The barrier rib structure is composed of a plurality of barrier rib units 48. A barrier rib unit 48 comprises a plurality of barrier ribs arranged in a horizontal direction (X direction as illustrated in FIG. 5) and parallel to each other formed on the back substrate, such as the barrier ribs 50*a*, 50*b* and 50*c*. A plurality of barrier ribs 52 arranged in a perpendicular direction (Y direction as illustrated in FIG. 5) and parallel to each other are formed on the back substrate. The barrier ribs 50*a*, 50*b* and 50*c* are designed to form a different width. Each of these barrier ribs 50*a*, 50*b* and 50*c* comprises a plurality of wide sections 54 and narrow sections 56. The barrier ribs 52 arranged in a perpendicular direction (y direction) are connected to the wide section 54 of the barrier ribs 50*a*, 50*b* and 50*c*.

The barrier ribs 52 arranged in a perpendicular direction are used to connect with the wide section 54 of the barrier ribs 50*a*, 50*b* and 50*c* arranged in a horizontal direction to divide a plurality of isolated discharge spaces 60. The corner portions of each discharge space 60 are formed by the wide sections 54. A barrier rib unit 48 includes a plurality of discharge spaces 60 arranged in two rows, as shown in FIG. 5. The non-discharge region 62 is used to isolate the barrier rib unit 48. In other words, barrier ribs do not exist in the non-discharge region 62 in the horizontal direction (x direction). Therefore, the non-discharge region 62 may be used as the gas channels during purging and refilling process.

Figure 6:
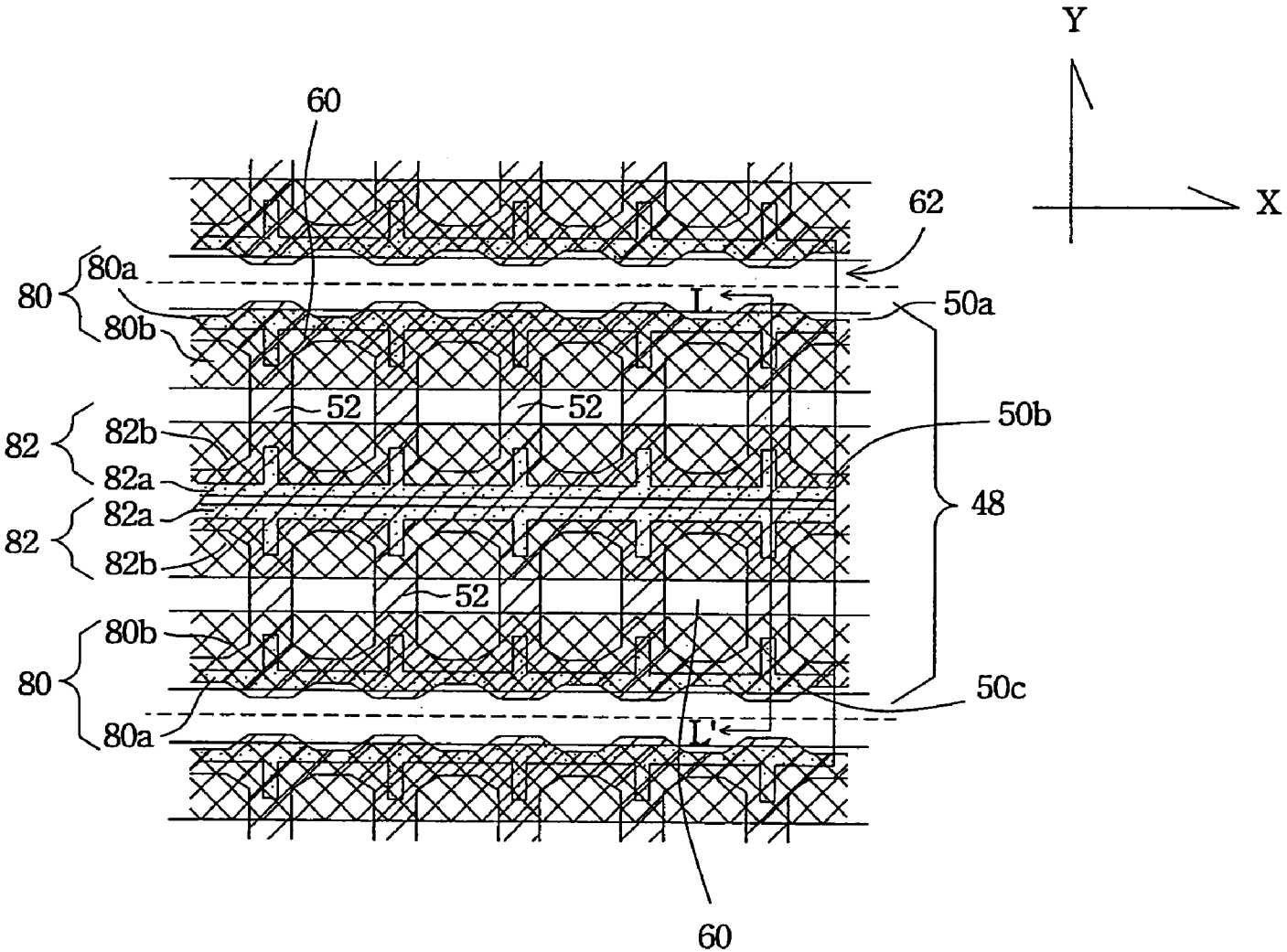
FIG. 6 is a schematic top view of a barrier rib structure and a front substrate of a plasma display panel according to one preferred embodiment of the present invention.

FIG. 6 is a schematic top view of a barrier rib structure and a front substrate of a plasma display panel according to one preferred embodiment of the present invention. The electrode structure located on the front substrate comprises a plurality of scan electrodes 80 arranged in parallel and common electrodes 82. The scan electrode 80 is composed of a bus electrode 80*a* and a transparent electrode 80*b*. The common electrode 82 is composed of a bus electrode 82*a* and a transparent electrode 82*b*. A luminescence row is composed of a scan electrode 80 and a common electrode 82. Each luminescence row is arranged in X direction (as illustrated in FIG. 6). A barrier rib unit 48 and two luminescence rows are collocated together. For example, as illustrated in FIG. 6, a scan electrode 80 is located over the barrier rib 50*a*. Two common electrodes are located over the barrier rib 50*b* and another scan electrode 80 is located over the barrier rib 50*c*. Each luminescence row is divided into a plurality of luminescence units, discharge spaces 60, by the barrier rib 52 arranged in perpendicular direction. Moreover, when a comb electrode is used as the bus electrode, the appearance of the barrier ribs arranged in perpendicular direction can be designed the same as the appearance of the branch line of the comb electrode. Such design can avoid the opaque bus electrode affect and can increase the illumination efficiency of the luminescence units. However, the bus electrode can also use another type design.

Figure 7:
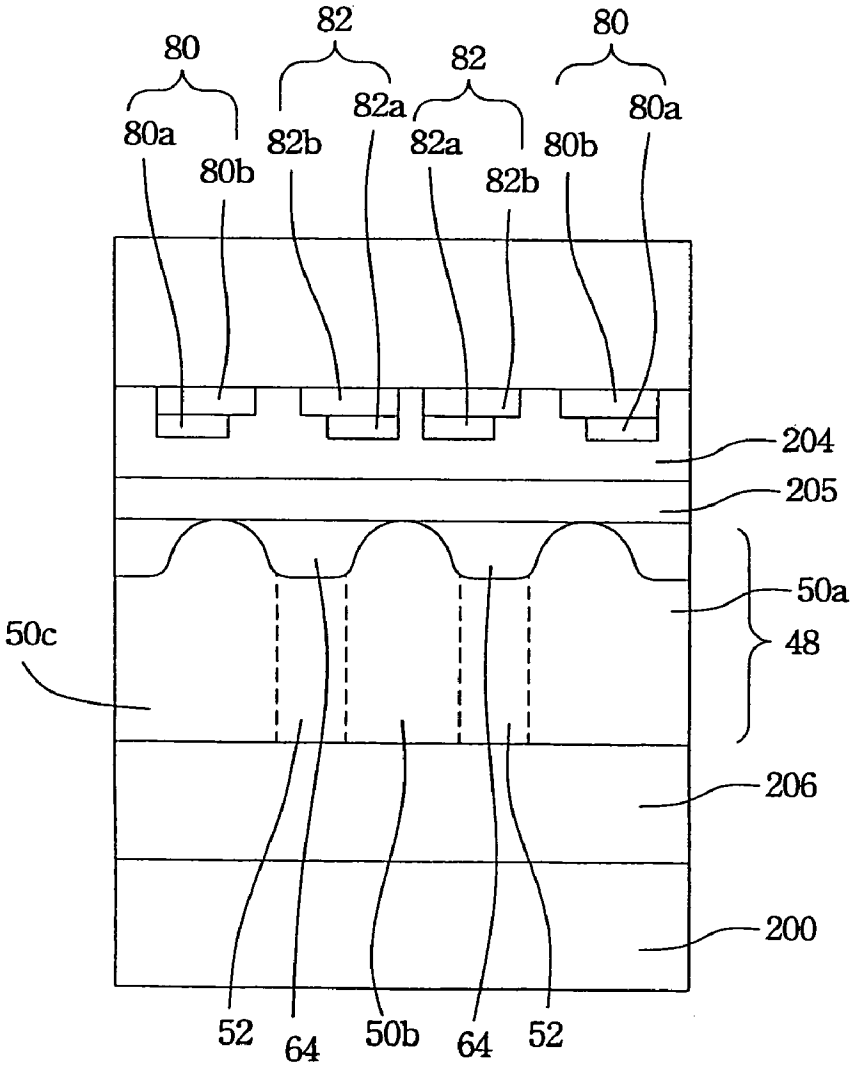
FIG. 7 is a schematic cross section view of a barrier rib unit of a plasma panel from the LL' plane illustrated in FIG. 6 according to one preferred embodiment of the present invention.

The barrier rib structure not only has different width but also has different height. FIG. 7 is a schematic cross section view of a barrier rib unit of a plasma display panel from the LL' plane illustrated in FIG. 6 according to one preferred embodiment of the present invention. A protective layer 205 is used to protect the scan electrode 80 and the common electrode 82 in a barrier rib unit 48. A higher height exists in the wide sections of the barrier ribs 50*a*, 50*b* and 50*c* in the barrier rib unit 48. The height of the barrier rib 52 is less than the height of the wide sections of the barrier ribs 50*a*, 50*b* and 50*c*. Therefore, a gas channel 64 is formed between the wide sections of the barrier ribs 50*a*, 50*b* and 50*c* and the barrier rib 52. Additionally, the height between the wide section and the narrow section is also different. Therefore, another gas channel is also formed thereon. However, this figure does not illustrate this gas channel. Because of the gas channel 64, the gas can flow among the discharge spaces 60 in FIG. 6, which improve the vacuuming and refilling gas efficiency.

Generally, the glass material can be used to form the barrier ribs. The manufacturing method for fabricating the barrier ribs having different height and size is described in the following. First, a glass material is provided. Glass powder and other material are used to form the glass material. Next, a printing process or a photolithography process is performed to make the glass material to form the barrier rib pattern having different width as illustrated in FIG. 5. After that, a sintering process is performed to harden the glass material. The structure of different width of each barrier rib may cause different contractibility during the sintering process. The different contractibility forms the height difference between the narrow section and the wide section, in which the height of the wide section is higher than the narrow section. The glass material is directly printed in the substrate according the barrier rib pattern in the printing process. On the other hand, according to the photolithography process, the glass material is formed on the substrate first. Next, a photoresist layer is formed over the glass material. Then, an exposure step is performed to pattern the photoresist layer. Finally, an etching step is performed to remove the exposed glass material to form the required barrier rib pattern.

The Waffle barrier rib structure described in the foregoing paragraphs is formed by the barrier ribs that are composed of wide sections and narrow sections and arranged in the horizontal direction and the barrier ribs that are arranged in the perpendicular and connected with the wide sections. However, the Waffle barrier rib structure, illustrated in FIG. 5, can also be formed by the barrier ribs that are composed of wide sections and narrow sections and arranged in the perpendicular and the barrier ribs that are arranged in the horizontal direction and connected with the wide sections. The feature of the present invention is that the barrier rib structure is composed of a plurality of barrier ribs arranged in a perpendicular direction (Y direction) and a plurality of barrier ribs arranged in a horizontal direction (X direction). A wider portion is formed in the intersection of the barrier ribs arranged in a perpendicular direction and the barrier ribs arranged in a horizontal direction. This intersection portion is wider than the width of the barrier ribs.

According to the preferred embodiment, the ratio of the narrow section to the wide section of the present invention is between 0.25 and 0.85. The structure of different width of each barrier rib may cause different contractibility during the sintering process. The different contractibility forms the height difference between the narrow section and the wide section, in which the height of the wide section is higher than the narrow section. In accordance with the preferred embodiment, the temperature of the sinter process is about 550° C. and the height difference is between about 3 μm and 15 μm.

Figure 8:
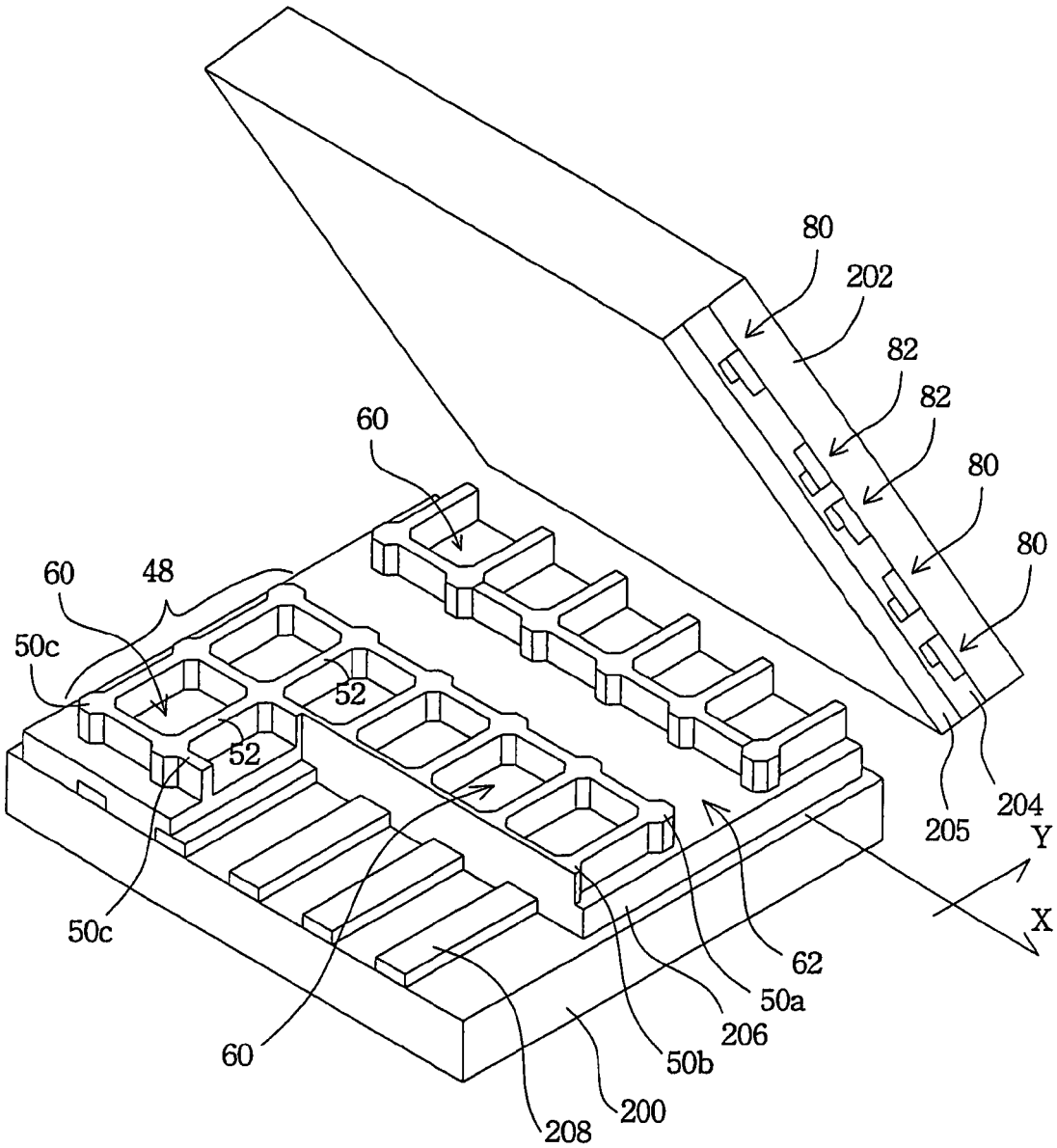
FIG. 8 is a schematic three-dimension diagram of a plasma display panel according to one preferred embodiment of the present invention.

FIG. 8 is a schematic three-dimensional diagram of a plasma display panel according to one preferred embodiment of the present invention. Referring to FIG. 7 and FIG. 8 together, on the inside surface of the front substrate 202, a plurality of parallel-arranged scan electrodes 80 and common electrodes 82 are formed. A dielectric layer 204 is formed on the front substrate 202 to cover the scan electrodes 80 and common electrodes 82. A protective layer 205 is formed on the dielectric layer 204. On the inside surface of the back substrate 200, a plurality of address electrodes 280, a dielectric layer 206 and a plurality of barrier rib units 48 are sequence formed. Each barrier rib unit 48 has a horizontal gas channel and a plurality of discharge spaces. The perpendicular barrier ribs of each barrier rib unit 48 are respectively located between two adjacent address electrodes 208, as shown in FIG. 8. Next, the front substrate 202 and the back substrate 200 are aligned and sealed. At this time, the scan electrodes 80 are located over the barrier ribs 50*c*. The common electrodes 80 are located over the barrier ribs 50*a*, 50*b*. Additional scan electrodes 80 are located over the barrier ribs 50*a*. Therefore, the scan electrodes and the common electrodes are perpendicular to the address electrodes 208. When the front substrate 202 and the back substrate 200 are combined together and the steps of vacuuming and refilling with mixed gas having a determined mixed ratio of special gas, such as He, Ne, Ar, or Xe, are completed, the PDP is finished.

Figure 9:
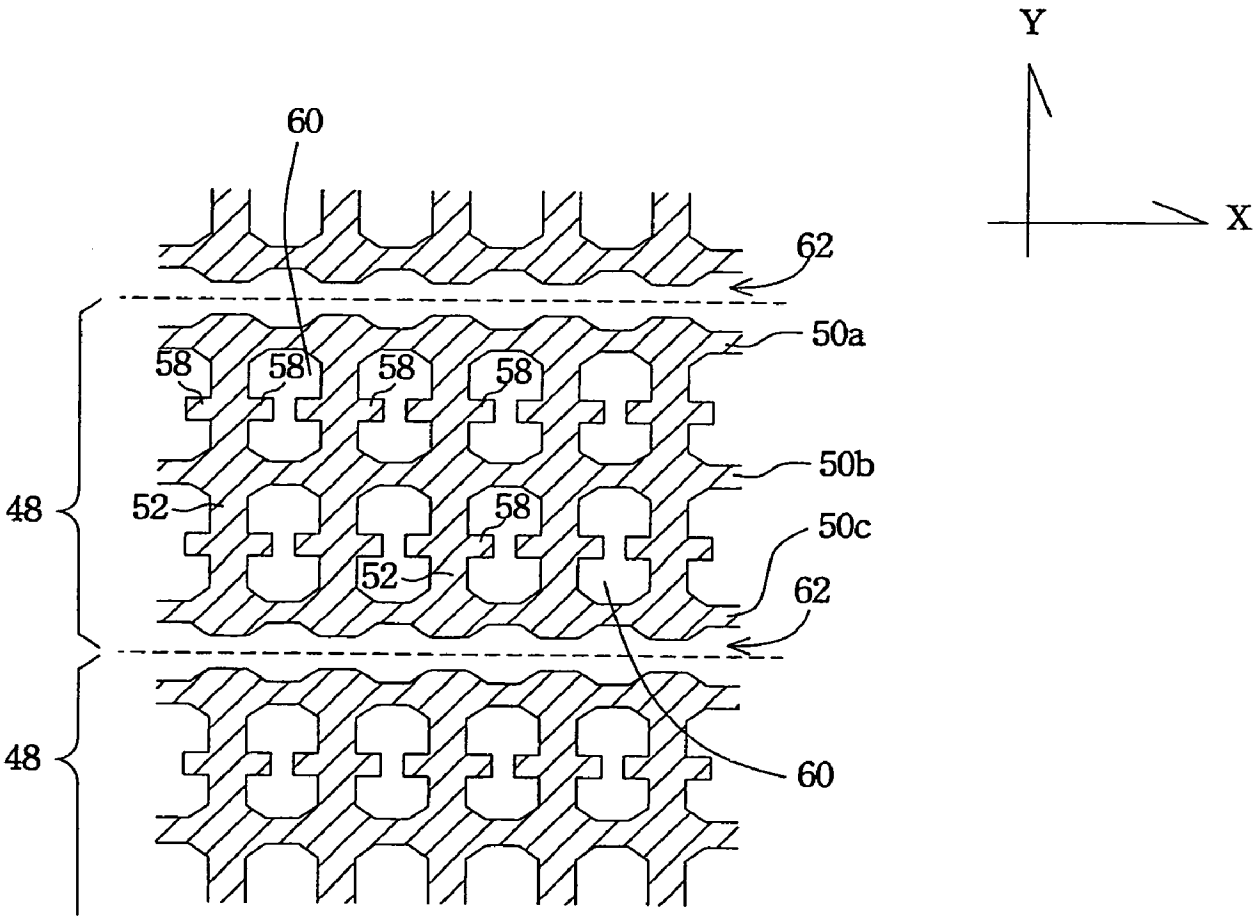
FIG. 9 is a schematic top view of a barrier rib structure of a plasma display panel according to another preferred embodiment of the present invention.

FIG. 9 is a schematic top view of a barrier rib structure of a plasma display panel according to another preferred embodiment of the present invention. Referring to FIG. 9, a fin-sharp barrier rib 58 is extended from the perpendicular barrier rib 52. In a discharge space 60, two fin-sharp barrier ribs are respectively extended from the perpendicular barrier ribs. These two fin-sharp barrier ribs do not have to be connected together. The fin-sharp barrier rib can divide the discharge spaces into two parts. Therefore, it is better to use this fin-sharp barrier rib structure in dual discharge center framework.

Figure 10:
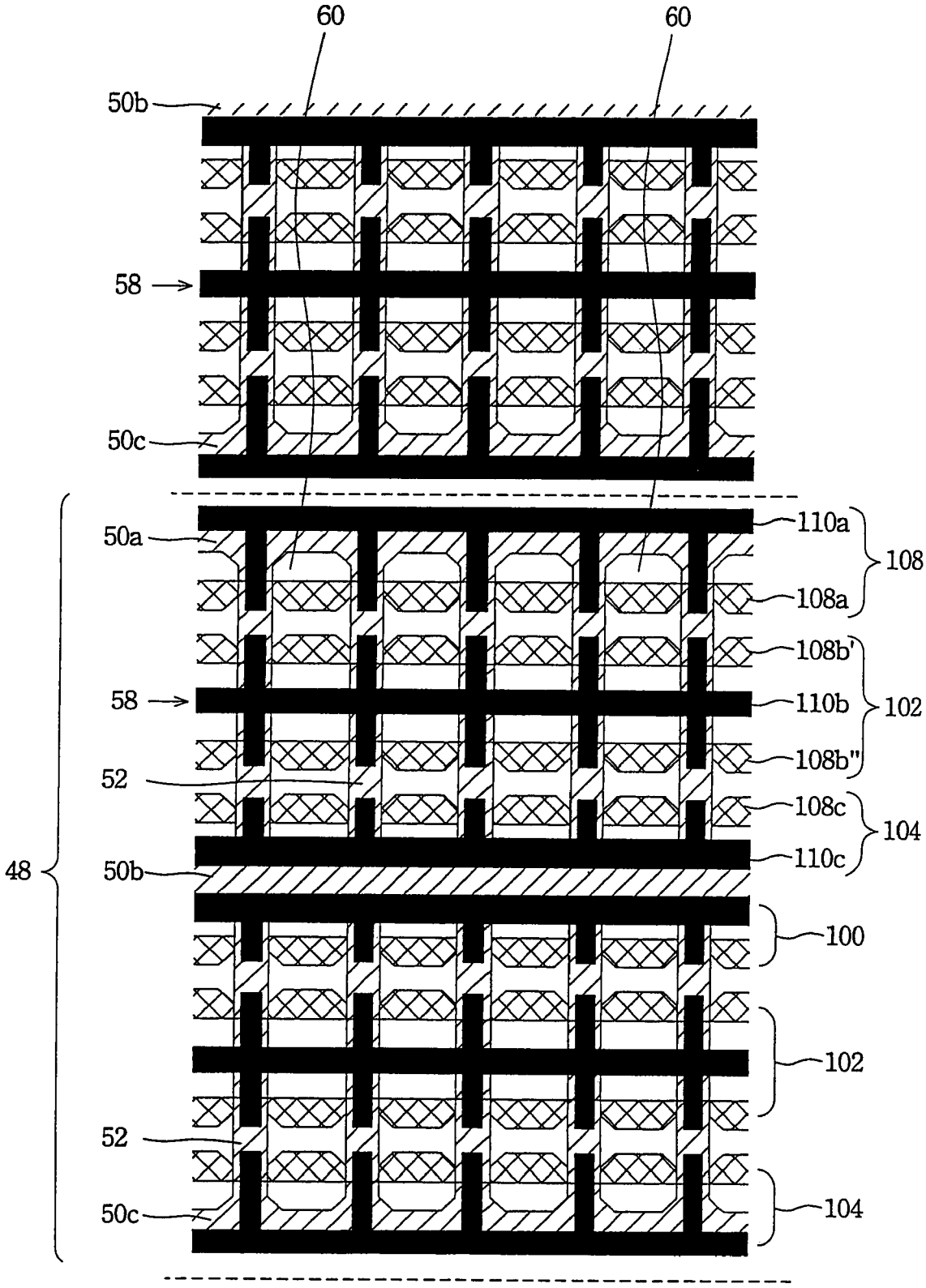
FIG. 10 is a schematic top view of a fin-sharp barrier rib structure and a dual discharge center of a plasma display panel according to one preferred embodiment of the present invention.

FIG. 10 is a schematic top view of a fin-sharp barrier rib structure and a dual discharge center of a plasma display panel according to one preferred embodiment of the present invention. Referring to FIG. 10, according to the dual discharge center framework, a pair of common electrodes 100 and 104 and a scan electrode 102 exists in a luminescence row. The common electrode 100 is composed of a bus electrode 110*a* and a transparent electrode 108*a*. The scan electrode is composed of a bus electrode 110*b*, a transparent electrode 108*b* and another transparent electrode 108*b*". The common electrode 104 is composed of a bus electrode 110*c* and a transparent electrode 108*c*. Although the perpendicular barrier ribs 52 divides the barrier rib unit 48 into a plurality of luminesce units, each luminesce unit is composed of two sub-luminesce units that are respectively composed of the common electrodes 100 and 104 and the scan electrode 102. For avoiding the two sub-luminesce units affected to each other, fin-sharp barrier ribs 58 are used to solve the above problem. The fin-sharp barrier ribs are located under the bus electrode 110*b* of the scan electrode 102. This fin-sharp barrier ribs 58 divides the discharge space 60 to two parts, sub discharge spaces, to avoid the erroneous discharge. Moreover, the opaque fin-sharp barrier ribs 58 and the bus electrode 110 do not affect the luminesce efficiency because of the dual discharge center framework. On the other hand, the two fin-sharp barrier ribs 58 are located in a discharge space and are not connected together. Therefore, these fin-sharp barrier ribs do not affect the vacuuming velocity.

Accordingly, those discharge spaces are isolated from each other. Therefore, almost-closed discharge spaces constrict energy in the discharge spaces as well as gas discharge, and this structure is helpful in utilizing gas discharge energy. In other words, the structure may inhibit unsuitable discharges in non-discharge regions during gas discharge to prevent erroneous discharge to increase the luminescence efficiency. Furthermore, because erroneous discharge does not occur, the width of the non-discharge region can be reduced to enlarge relatively the size of the discharge spaces in the discharge region, and the opening ratio is thus increased. Moreover, this structure does not use the horizontal gas channel. Therefore, the discharge space can be enlarged. In other words, the structure may increase the fluorescencer coating are of each discharge space to improve luminescence efficiency.

According to the embodiment of the present invention, the structure of each barrier rib is composed of wide sections and narrow sections. The ratio of the narrow section to the wide section in accordance with the present invention is between 0.25 and 0.85 and the height difference is between about 3 μm and 15 μm. This barrier rib structure can be used in a single discharge center structure or a dual discharge center structure. On the other hand, the fin-sharp barrier rib structure is better used in a dual discharge center structure.

The different width structure causes different contractibility during the sintering process. The different contractibility forms height differences for each barrier rib, so that some gas channels are formed after the front and back glass plates of the PDP are adhered to each other. These gas channels are helpful to gas purging and refilling between the discharge and non-discharge regions during manufacture of a PDP device. Moreover, compared with the conventional strip barrier rib structure, the horizontal channel is removed. Therefore, the area of the discharge unit is enlarged. Accordingly, the total fluorescencer coating area of each discharge unit is increased, and thus the luminescence efficiency is improved.

This barrier rib structure of the present invention may increase the fluorescencer coating area of each discharge space to improve luminescence efficiency. For example, the wide section of the barrier rib illustrated in FIG. 5 is similar to an octagon sharp. According to the conventional strip-sharp barrier ribs, the fluorescencer coating area of each discharge space is only three planes, including one bottom and two side wall planes. According to the square-sharp barrier ribs, the fluorescencer coating area of each discharge space is only five planes, including one bottom and four side wall planes. However, according to the present invention, the fluorescencer coating area of each discharge space is nine planes, including one bottom and eight side walls.

Accordingly, the present invention provides a barrier rib structure having different width for a plasma display panel. The structure cannot only strengthen the barrier ribs but can also provide the following advantages. First, a glass material is used to form the barrier ribs. Therefore, the color of the barrier ribs is white. Therefore, if a non-reflection material (such as a black color material) is coated on the surface of the perpendicular and the horizontal barrier ribs, the wide section can restrain the reflection light, which can improve the contrast. Moreover, the wide section can increase the adhering area of the photoresist when performing the photolithography process.

According to the present invention, three horizontal barrier ribs are used to form a barrier rib unit having luminance units arranged in two rows. However, this structure can be changed according to the requirement of the product. Moreover, according to the present invention, the horizontal barrier ribs 50*a* and 50*c* are related to the scan electrode and the horizontal barrier ribs 50*b* are related to the common electrode. However, that structure is only a preferred embodiment. The scope of the present invention does not be limited by the preferred embodiment.

As will be understood by a person skilled in the art, the foregoing preferred embodiments of the present invention are illustrative of the present invention rather than limiting of the present invention. They are intended to cover various modifications and similar arrangements included within the spirit and scope of the appended claims, the scope of which should be accorded the broadest interpretation so as to encompass all such modifications and similar structure.

What is claimed is:

1. A method for forming plasma display panel structure comprising:

forming a plurality of address electrodes on a back substrate, wherein said address electrodes are arranged in parallel to each other;

forming a dielectric layer over said address electrodes and said back substrate;

forming a barrier rib structure over said dielectric layer, wherein said barrier rib structure comprises:

a plurality of barrier ribs arranged in the first direction and parallel to each other, wherein each of said barrier ribs is formed by a plurality of wide sections and narrow sections, and said wide sections and said narrow sections are alternately formed in the first direction, and said barrier ribs comprises a first barrier rib, a second barrier rib and a third barrier rib; and a plurality of barrier ribs with a fin-sharp barrier ribs extended from said barrier ribs arranged in a second direction and parallel to each other and located between said barrier ribs arranged in a first direction, wherein said barrier ribs arranged in a second direction are respectively connected with corresponding said wide sections to form a plurality of discharge spaces;

performing a sintering process to form a height difference said wide sections and said narrow sections; and covering a front substrate over said barrier rib structure.

2. The method according to claim 1, wherein said first direction is perpendicular to said second direction.

3. The method according to claim 1, wherein a ratio of said narrow section to said wide section is about between 0.25 and 0.85.

4. The method according to claim 1, wherein said height difference is between about 3 μm and 15 μm.

5. The method according to claim 1, wherein each discharge space includes one bottom and eight side walls.

6. The method according to claim 1, wherein said sintering process temperature is about 550° C.

* * * * *